US005351108A

United States Patent [19]

Mizutani

[11] Patent Number: 5,351,108

[45] Date of Patent: Sep. 27, 1994

[54] CONVEYOR ROLLER CLEANING DEVICE

[75] Inventor: Naoki Mizutani, Osaka, Japan

[73] Assignee: Mita Industrial Co., Ltd., Osaka, Japan

[21] Appl. No.: 5,332

[22] Filed: Jan. 19, 1993

[30] Foreign Application Priority Data

Jan. 20, 1992 [JP] Japan ..... 4-007819

[51] Int. Cl.[5] ..... G03G 21/00

[52] U.S. Cl. ..... 355/215; 355/308

[58] Field of Search ..... 355/308, 309, 311, 321, 355/316, 317, 215, 200

[56] References Cited

U.S. PATENT DOCUMENTS

| | | | |
|---|---|---|---|
| 4,370,050 | 1/1983 | Matsui et al. | 355/215 |
| 4,544,262 | 10/1985 | Kanemitsu et al. | 355/315 |
| 4,681,422 | 7/1987 | Oba et al. | 355/309 |
| 4,878,657 | 11/1989 | Ura et al. | 355/215 X |
| 5,227,843 | 7/1993 | Yamamoto et al. | 355/210 |
| 5,245,394 | 9/1993 | Ikeda et al. | 355/309 |

FOREIGN PATENT DOCUMENTS

| | | |
|---|---|---|
| 59-53859 | 3/1984 | Japan . |
| 61-171067 | 10/1986 | Japan . |
| 62-22670 | 2/1987 | Japan . |
| 63-289574 | 11/1988 | Japan . |
| 03-55564 | 3/1991 | Japan . |

*Primary Examiner*—A. T. Grimley
*Assistant Examiner*—Nestor R. Ramirez
*Attorney, Agent, or Firm*—Antonelli, Terry, Stout & Kraus

[57] ABSTRACT

A conveyor roller cleaning device is mounted on the body of an image forming apparatus for cleaning the peripheral surface of a conveyor roller rotatably mounted on the body of the apparatus. The device includes an elastic member adapted to be pressed into contact with the roller, an attaching member provided at the tip end thereof with the elastic member, a drive source for driving the roller and drive control device for controlling the drive source. The attaching member is rotatable around the base end thereof between a setting position in which the elastic member is pressed into contact with the roller and a retreat position in which the elastic member is retracted away from the roller. The attaching member is maintained at the setting position by a reaction force corresponding to the pressing-contact force of the elastic member to the roller. The drive control device is adapted such that, before paper to be conveyed reaches the roller, the roller is rotated in a predetermined direction for a predetermined period of time to produce, between the peripheral surface of the roller and the elastic member, a frictional force by which the attaching member is biased toward the setting position.

26 Claims, 4 Drawing Sheets

CONVEYOR ROLLER CLEANING DEVICE

BACKGROUND OF THE INVENTION

The present invention relates to a conveyor roller cleaning device in which an elastic member is adapted to be pressed into contact with a conveyor roller for cleaning the same.

Generally, an image forming apparatus, such as a copying machine or the like, incorporates a conveyor roller cleaning device for cleaning a conveyor roller disposed in a paper conveyor unit for conveying a transfer sheet. In such a conveyor roller cleaning device, an elastic member is pressed into contact with the conveyor roller at the peripheral surface thereof, thus removing paper powder sticking to the conveyor roller.

This elastic member is attached to the tip end of an attaching member which is rotatable around its own base. When set to a setting position, the attaching member causes the elastic member to be pressed into contact with the conveyor roller. The attaching member set to the setting position, is maintained thereat by a reaction force corresponding to the pressing-contact force of the elastic member toward the conveyor roller.

In the conveyor roller cleaning device, at the time of clearing a jam or other maintenance processing the attaching member is rotated from the setting position and retracted to a retreat position where the attaching member does not get in the way of the maintenance processing.

However, there are instances where the attaching member is not securely set to the setting position after the maintenance processing has been executed with the attaching member moved to the retreat position. More specifically, although it is required that a predetermined pushing force to the attaching member in order to resist a reaction force be applied corresponding to the pressing-contact force for pressingly contacting the elastic member to the conveyor roller, the service engineer often fails to do so.

If the attaching member is not securely set to the setting position after completion of the maintenance processing, it is not assured that a sufficient pressing-contact force of the elastic member to the conveyor roller is provided. This results in poor cleaning. Such poor cleaning may take place not only after the maintenance processing has been executed, but also when the attaching member is not securely set.

SUMMARY OF THE INVENTION

In view of the foregoing, the present invention is proposed with the object of providing a conveyor roller cleaning device, and an image forming apparatus incorporating the same, which can prevent the occurrence of defective cleaning due to defective setting of the attaching member.

To achieve the object above-mentioned, a conveyor roller cleaning device according to a preferred embodiment of the present invention is to be mounted on the body of an image forming apparatus for cleaning the peripheral surface of a conveyor roller which is included in a transfer sheet conveyor unit for conveying a transfer sheet and which is rotatably mounted on the body of the image forming apparatus, and the conveyor roller cleaning device of the present invention comprises:

an elastic member to be pressed into contact with the conveyor roller for cleaning the peripheral surface thereof;

an attaching member, provided at the tip end thereof with the elastic member and supported by the body of the image forming apparatus in a manner rotatable around the base end thereof between a setting position in which the elastic member is pressed into contact with the conveyor roller and a retreat position in which the elastic member is retracted away from the conveyor roller, the attaching member being maintained at the setting position by a reaction force corresponding to the pressing-contact force of the elastic member to the conveyor roller;

drive means for driving the conveyor roller; and drive control means for controlling the drive means such that, before paper to be conveyed by the transfer sheet conveyor unit reaches the conveyor roller, the conveyor roller is rotated in a predetermined direction for a predetermined period of time, thus producing, between the peripheral surface of the conveyor roller and the elastic member, a frictional force by which the attaching member is biased to the setting position.

An image forming apparatus according to another preferred embodiment of the present invention comprises a transfer sheet conveyor unit including a conveyor roller rotatably mounted on the body of the image forming apparatus and a conveyor roller cleaning device to be mounted on the body of the image forming apparatus for cleaning the peripheral surface of the conveyor roller, the conveyor roller cleaning device comprising:

an elastic member to be pressed into contact with the conveyor roller for cleaning the peripheral surface thereof;

an attaching member, provided at the tip end thereof with the elastic member and supported by the body of the image forming apparatus in a manner rotatable around the base end thereof between a setting position in which the elastic member is pressed into contact with the conveyor roller and a retreat position in which the elastic member is retracted away from the conveyor roller, the attaching member being maintained at the setting position by a reaction force corresponding to the pressing-contact force of the elastic member to the conveyor roller;

drive means for driving the conveyor roller; and drive control means for controlling the drive means such that, before paper to be conveyed by the transfer sheet conveyor unit reaches the conveyor roller, the conveyor roller is rotated in a predetermined direction for a predetermined period of time, thus producing, between the peripheral surface of the conveyor roller and the elastic member, a frictional force by which the attaching member is biased to the setting position.

According to either the conveyor roller cleaning device and the image forming apparatus of the present invention, the conveyor roller is adapted to be driven for a predetermined period of time by the drive control means, and a frictional force is produced between the peripheral surface of the conveyor roller and the elastic member as the conveyor roller is driven. By this frictional force, the attaching member can be biased toward the setting position through the elastic member. The drive control means is adapted to be operated before a transfer sheet which has been fed, reaches the conveyor roller. Accordingly, even though the attaching member has not been securely set to the setting position, the attaching member can be automatically and securely set to the setting position. This prevents the occurrence of defective cleaning due to defective setting of the attaching member.

Preferably, the conveyor roller includes a resist roller for adjusting the timing at which a transfer sheet is conveyed. In such an arrangement, the drive control mechanism of the resist roller can be used as the drive control means. This does not cause the entire structure to be complicated.

Preferably, the drive control means is adapted to be operated in response to an image formation start signal. In such an arrangement, the drive control means can be operated at timing before a transfer sheet reaches the conveyor roller, without the necessity of setting a particularly difficult timing.

Preferably, only when a maintenance processing is executed, the drive control means is operated at a point of time between the time of completion of the maintenance processing and the time when a transfer sheet which has been fed, reaches the conveyor roller. It is considered that the setting of the attaching member is liable to become uncertain when a maintenance processing is executed, and the setting of the attaching member does not become uncertain when no maintenance processing is executed. In this connection the drive control means is adapted to be operated only when a maintenance processing is executed, thus eliminating an unnecessary operation of the drive control means at the time when no maintenance processing is executed.

For operating the drive control means only when a maintenance processing is executed, provision may be made such that the drive control means can be operated in response to a reset signal supplied after completion of the maintenance processing, or an image formation start signal. In such an arrangement, the drive control means can be readily operated at timing between the time of completion of the maintenance processing and the time when the transfer sheet reaches the conveyor roller.

DETAILED DESCRIPTION OF THE PREFERRED EMBODIMENTS

The following description will discuss in detail the present invention with reference to the attached drawings showing embodiments thereof.

Figure 1:
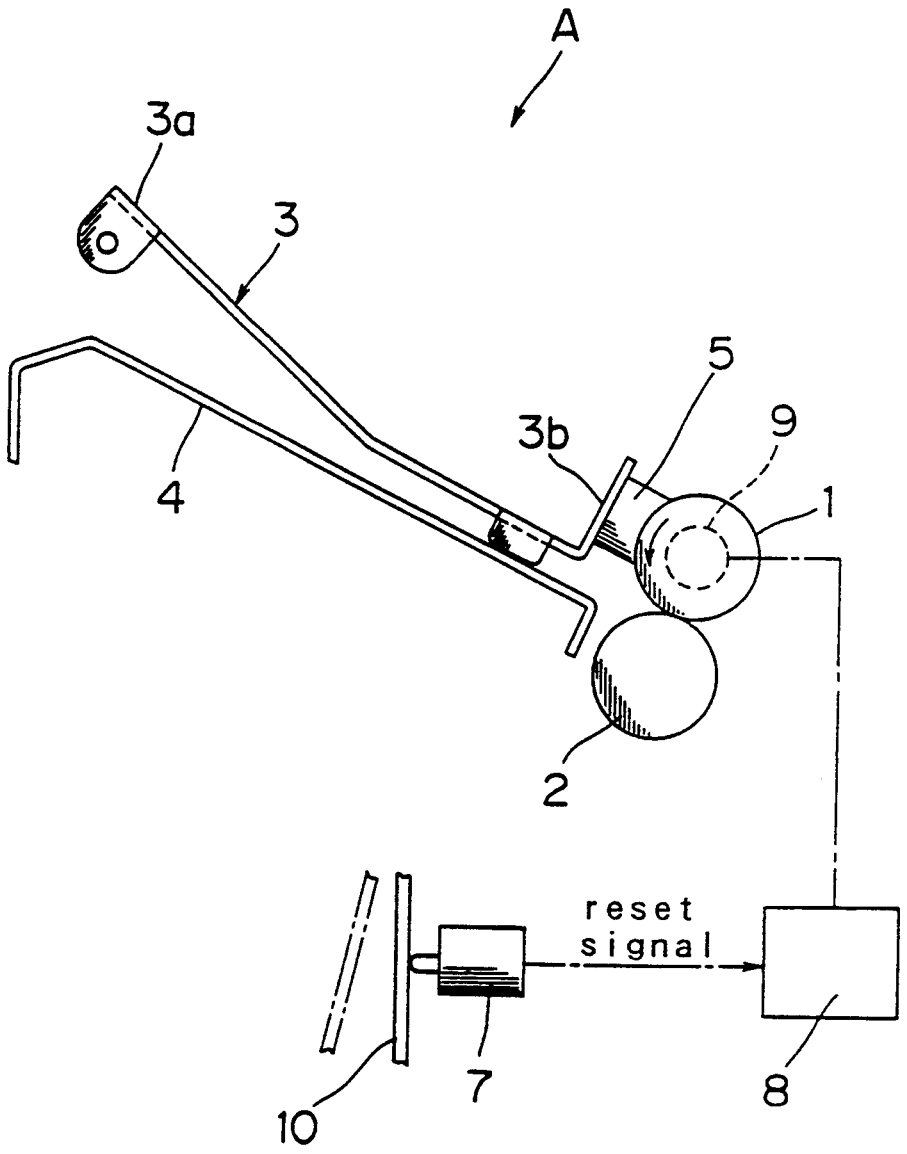
FIG. 1 is a schematic view of the arrangement of a conveyor roller cleaning device according to an embodiment of the present invention.
Figure 2:
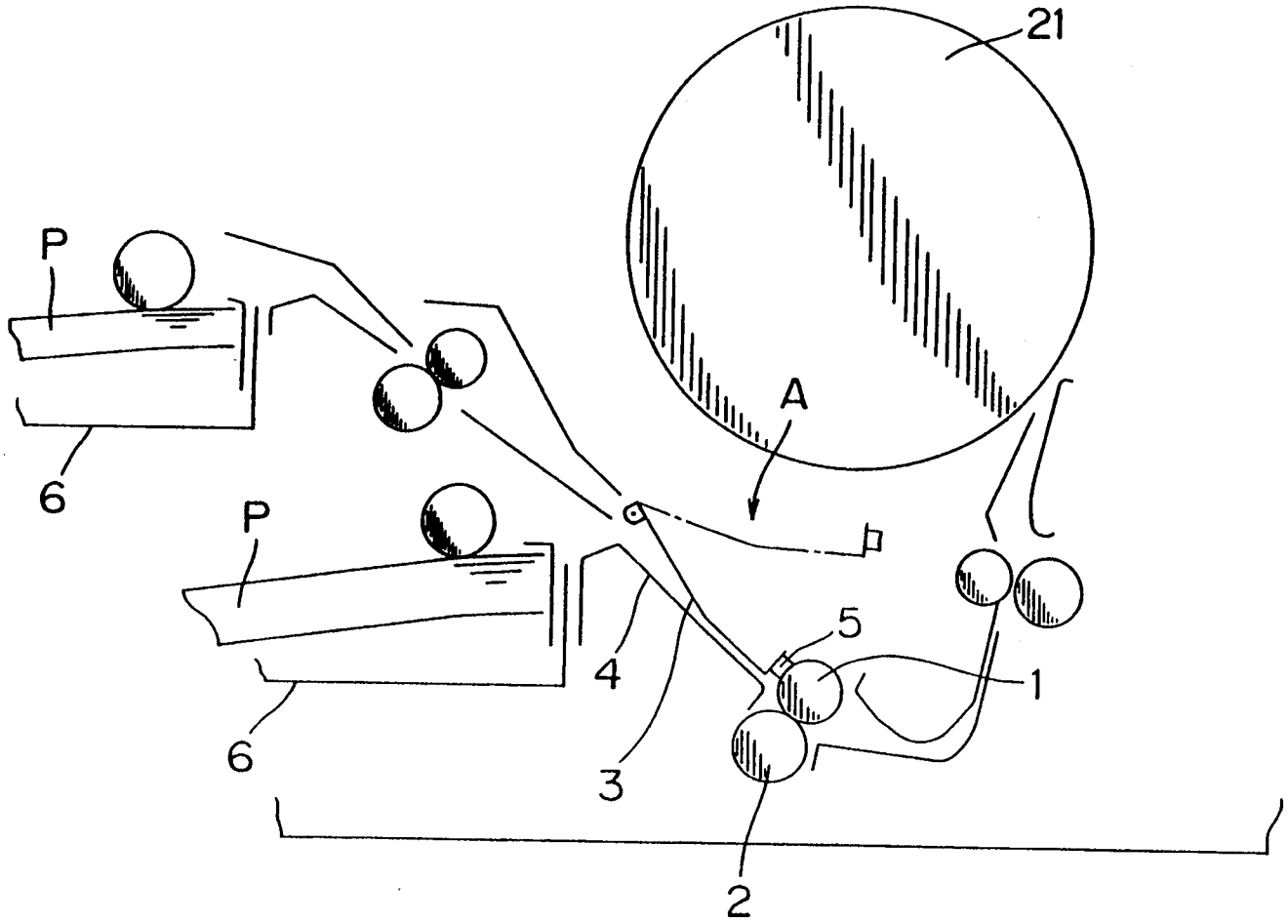
FIG. 2 is a schematic view of portions of a copying machine incorporating the conveyor roller cleaning device shown in FIG. 1.

Referring to FIG. 2, conveyor rollers 1, 2, which also serve as resist rollers, are disposed in a paper conveying passage formed from paper cassettes 6 housing paper P as transfer sheets, toward a photoreceptor drum 21. A pair of conveyor guide plates 3, 4 for guiding the conveyance of the paper P are interposed between the conveyor rollers 1, 2 and the paper cassettes 6. In FIG. 1, the upper conveyor guide plate 3 is pivotable around the base end 3*a*thereof. The conveyor guide plate 3 is provided at the tip end 3*b* thereof with a roller cleaning elastic member 5 adapted to be pressed into contact with the conveyor roller 1.

A conveyor roller cleaning device A comprises the conveyor guide plate 3 serving as the attaching member, the elastic member 5, a reset switch 7 which is adapted to be operated when a front cover 10 of the copying machine is opened or closed at the time of a maintenance processing, such as a jam processing or the like, and which is adapted to supply a reset signal when the front cover 10 is closed, and drive control means 8 for driving the conveyor roller 1 in a predetermined direction for a predetermined period of time in response to the reset signal. In the conveyor roller cleaning device A, since the conveyor guide plate 3 also serves as the attaching member for the elastic member 5, the entire structure is simplified in a compact design.

Figure 4:
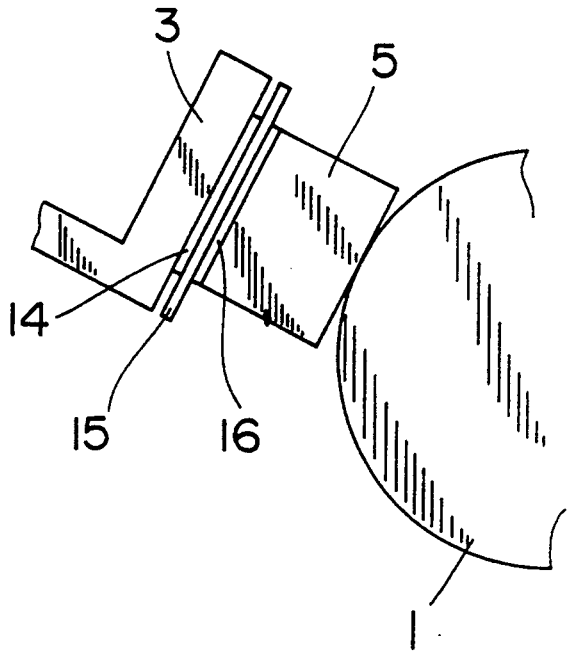
FIG. 4 is an enlarged view of main portions of the conveyor roller cleaning device.

Referring to FIG. 4, between the conveyor guide plate 3 and the elastic member 5, a double-sided tape 14, a synthetic resin film 15 and a double-sided tape 16 are interposed in this order from the side of the conveyor guide plate 3.

As the elastic member 5, there may be used a urethane foam such as ECS, ECT, ECZ, EFF and EFD of the ether type manufactured by Inoack Corporation, SC, SM-55, SM-65, MF-50, USC and USM of the ester type also manufactured by Inoack Corporation, and HR-50 and HB-50 of the ester type manufactured by Bridgestone Co., Ltd. Further, as the elastic member 5, there may also be used an acrylic pile material (e.g., 52 two ply yarns/inch$^2$or 77 two ply yarns/inch$^2$).

The synthetic resin film 15 is thin and rectangular Except for both surfaces of the ends 151 (FIG. 5), the synthetic resin film 15 is stuck to the double-sided tapes 14, 16. That is, the ends 151 of the synthetic resin film 15 outwardly project from the sticky surfaces of the double-coated tapes 14, 16.

As the material of the synthetic resin film 15, there can be mentioned PET (polyethylene terephthalate) such as LUMIRROR and LUMIRROR Z210 manufactured by Toray Co., Ltd., DIAFOIL, DIAFOIL N200 and DIAMIRROR manufactured by Mitsubishi Jyushi Co., Ltd. Also, synthetic resin such as polypropylene or the like may be used.

Examples of the double-coated tapes 14, 16 include tapes of No. 500 and No. 501PN manufactured by Nitto Denko Co., Ltd., T4000 manufactured by Sony Chemical Co., Ltd., and 575 and 595 manufactured by Sekisui Kagaku Kogyo Co., Ltd.

Figure 5:
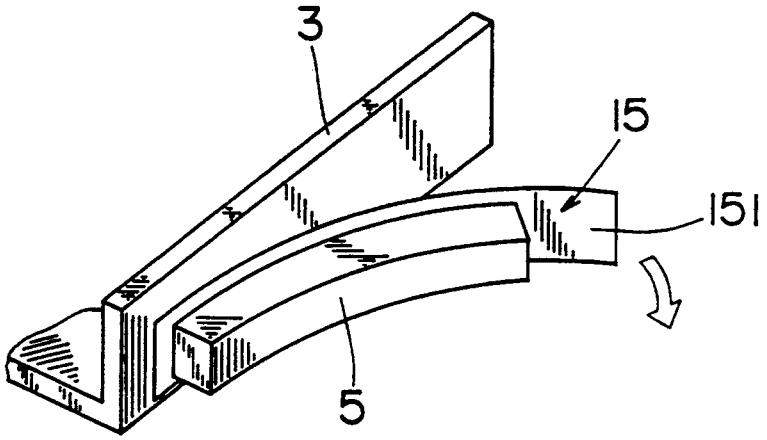
FIG. 5 is a perspective view illustrating how to replace the elastic member.

For replacing the used elastic member 5, the synthetic resin film 15 interposed between the elastic member 5 and the conveyor guide plate 3 is removed so that the elastic member 5 can be readily and perfectly removed, as shown in FIG. 5. Thus, portions of the elastic member 5 do not remain attached to the conveyor guide plate 3 as conventionally occurs. This eliminates the need to remove such remaining portions of the elastic member. This improves the efficiency of replacing the elastic member 5. Further, since the synthetic resin film 15 and the double-sided tapes 14, 16 are inexpensive, the cleaning device can be produced at a low cost. The adhesive force between the double-sided tape 14 made of synthetic resin and the synthetic resin film 15 is stronger than the adhesive force between the double-sided tape 14 and the conveyor guide plate 3 made of metal.

Accordingly, when removing the synthetic resin film 15, the double-sided tape 14 is also removed together with the film 15. Even if the double-sided tape 14 is not removed but remains on the conveyor guide plate 3, the remaining tape 14 does not constitute an obstacle to attachment of a new elastic member 5, since the double-sided tape 14 is very thin.

Further, since both surfaces of the ends 151 of the synthetic resin film 15 outwardly project from the sticky surfaces of the double-sided tapes 14, 16, the service engineer can hold and pull a projecting end 151 to enable the elastic member 5 to be further readily removed. Adhesives can be used instead of the double-sided tape 16 interposed between the synthetic resin film 15 and the elastic member 5.

The conveyor guide plate 3 is rotatable around the base end 3*a*thereof between a setting position in which the elastic member 5 is pressed into contact with the conveyor roller (shown by a solid line in FIG. 2) and a retreat position where the elastic member 5 is retracted from the conveyor roller such that a maintenance processing can be executed (shown by a chain line in FIG. 2). FIG. 1 shows the conveyor guide plate 3 located in the setting position.

Provision is made such that the conveyor guide plate 3 is maintained at the setting position by a reaction force corresponding to the pressing-contact force of the elastic member 5 to the conveyor roller 1.

Referring to FIG. 1, there are also disposed clutches 9 adapted to be engaged and disengaged to transmit and not to transmit a driving force to the conveyor roller 1. The drive control means 8 is operated such that in response to a reset signal from the reset switch 7, the clutches 9 are engaged for a predetermined period of time (e.g., 1 second) to drive the conveyor roller 1, and then the clutches 9 are disengaged to stop driving the conveyor roller 1. The driving direction of the conveyor roller 1 is set in such a direction that, through the elastic member 5, the conveyor roller 1 biases the conveyor guide plate 3 toward the setting position. As the clutches 9, there may be used known spring clutches to be actuated by turning a solenoid to on or off.

Figure 3:
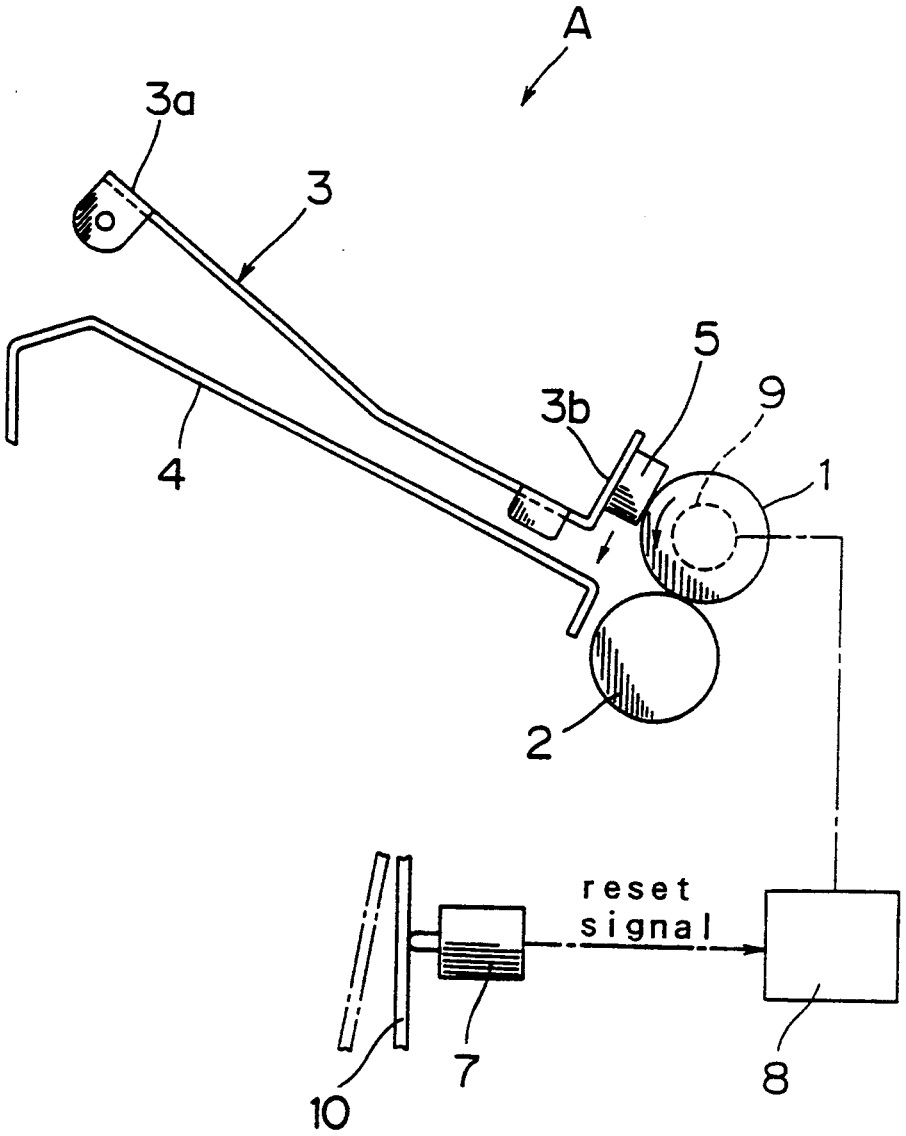
FIG. 3 is a schematic view of the conveyor roller cleaning device in which the attaching member is not securely set.

According to this embodiment, when the user closes the front cover 10 after completion of a maintenance processing, such as a jam processing or the like, the reset switch 7 supplies a reset signal. In response to the reset signal, the drive control means 8 engages the clutches 9 for a predetermined period of time to rotatingly drive the conveyor roller 1. This produces a frictional force between the peripheral surface of the conveyor roller 1 and the elastic member 5. This frictional force acts as a biasing force for biasing the conveyor guide plate 3 toward the setting position through the elastic member 5. Accordingly, even though the user has not securely set the conveyor guide plate 3 to the setting position (See FIG. 3), the biasing force resulting from the frictional force enables the conveyor guide plate 3 to be automatically and securely set to the setting position. This prevents the occurrence of defective cleaning due to defective setting of the conveyor guide plate 3 after a maintenance processing has been executed.

The conveyor guide plate 3 is liable to be defectively set particularly after a maintenance processing has been executed. However, this embodiment is arranged such that the conveyor guide plate 3 is automatically set to the setting position only when a maintenance processing has been executed. This eliminates an unnecessary operation of the drive control means 8. Further, the drive control means 8 is operated in response to a reset signal supplied after completion of a maintenance processing. Accordingly, without the need to set a particularly difficult timing, the drive control means 8 can be readily operated at timing between the time of completion of a maintenance processing and the time when paper P reaches the conveyor roller 1.

Further, since the conveyor roller 1 also serves as a resist roller, the drive control mechanism of this resist roller can be used as the drive control means 8. This does not cause the entire structure to be complicated.

In this embodiment, the conveyor guide plate 3 also serves as the attaching member for the elastic member 5. In such an arrangement, when the conveyor guide plate 3 has not been securely set to the setting position, there is the likelihood that not only the roller is not properly cleaned, but also paper cannot be smoothly conveyed by the conveyor guide plate 3, which may provoke a new paper jam. In the embodiment, however, the conveyor guide plate 3 can be securely set in the manner above-mentioned, thus eliminating such concern.

According to the embodiment, the conveyor guide plate also serves as the attaching member for the elastic member 5, but the attaching member may be disposed independently from the conveyor guide plate.

The embodiment is arranged such that the drive control means 8 is operated in response to a reset signal supplied after completion of a maintenance processing. However, provision may be made such that the drive control means 8 is operated at timing between the time of completion of a maintenance processing and the time when paper P reaches the conveyor roller 1. Further, provision may be made such that the drive control means 8 is operated at timing before paper reaches the conveyor roller 1, regardless of completion of a maintenance processing.

Further, when provision is made such that the drive control means 8 is operated in response to a copy start signal, the drive control means 8 can be operated at timing before paper P reaches the conveyor roller 1, without the need to set a particularly difficult timing.

The present invention may be embodied in other specific forms without departing from the scope thereof. For example, the present invention may be applied to other conveyor roller than the resist roller.

WHAT IS CLAIMED IS:

1. A conveyor roller cleaning device to be mounted on the body of an image forming apparatus for cleaning a peripheral surface of a conveyor roller which is included in a transfer sheet conveyor unit for conveying a transfer sheet and which is rotatably mounted on the body of the image forming apparatus, said conveyor roller cleaning device comprising:

an elastic member adapted to be pressed into contact with delete the conveyor roller for cleaning the peripheral surface thereof;

an attaching member having a base end and a tip end, with said elastic member connected to said tip end, said base end adapted to be pivotably supported by the body of the image forming apparatus to permit pivoting of said attaching member around said base end between a setting position in which said elastic member is pressed into contact with the conveyor roller and a retreat position in which said elastic member is retracted away from the conveyor roller, said attaching member being maintained at said setting position by a reaction force corresponding to the pressing-contact force of said elastic member against the conveyor roller;

drive means for driving the conveyor roller;

drive control means for controlling said drive means such that, before paper to be conveyed by the transfer sheet conveyor unit reaches the conveyor roller, said drive means rotates the conveyor roller in a predetermined direction for a predetermined period of time, producing between the peripheral surface of the conveyor roller and said elastic member a frictional force by which said attaching member is biased to said setting position.

2. A conveyor roller cleaning device according to claim 1, wherein the conveyor roller comprises a resist roller for adjusting timing of conveying of a transfer sheet .

3. A conveyor roller cleaning device according to claim 1, wherein said drive control means is responsive to an image formation start signal.

4. A conveyor roller cleaning device according to claim 1, wherein said drive control means is responsive to execution of a maintenance processing on the image forming apparatus, to be operated at a point of time between the time of completion of the maintenance processing and the time when a transfer sheet to be conveyed by the transfer sheet conveyor unit reaches the conveyor roller.

5. A conveyor roller cleaning device according to claim 4, wherein said drive control means is further responsive to an image formation start signal.

6. A conveyor roller cleaning device according to claim 4, wherein said drive control means is further responsive to a reset signal supplied after completion of the maintenance processing.

7. A conveyor roller cleaning device according to claim 6, further comprising a limit switch for generating the reset signal in response to closing of a front cover of the body of the image forming apparatus.

8. A conveyor roller cleaning device according to claim 1, wherein i said drive means includes:

(a) clutch means adapted to be engaged and disengaged to transmit and not transmit a driving force to the conveyor roller; and (b) clutch operating means for operating said clutch means; and said drive control means causes said clutch operating means to operate said clutch means to transmit the driving force to rotate said conveyor roller.

9. A conveyor roller cleaning device according to claim 1, wherein said attaching member comprises a conveyor guide plate for guiding a transfer sheet to be conveyed by the conveyor roller downstream in the conveying direction.

10. A conveyor roller cleaning device as claimed in claim 1, further comprising:

a first double-sided tape having a first surface stuck to said tip end of said attaching member and having a second surface;

a synthetic resin film having a first surface stuck to said second surface of said first double-sided tape and having a second surface; and a second double-sided tape having a first surface stuck to said second surface of said synthetic resin film and having a second surface stuck to said elastic member, thereby connecting said elastic member to said tip end.

11. A conveyor roller cleaning device as defined in claim 10, wherein said synthetic resin film includes a first portion stuck to said first and second double-sided tapes and an end portion not stuck to either said first or said second double-sided tape.

12. A conveyor roller cleaning device as claimed in claim 1, further comprising:

a double-sided tape having a first surface stuck to said tip end of said attaching member and a second surface;

a synthetic resin film having a first surface stuck to said second surface of said double-sided tape and a second surface with said elastic member adhered thereto by an adhesive, thereby connecting said elastic member to said tip end.

13. A conveyor roller cleaning device as claimed in claim 12, wherein said synthetic resin film includes a first portion stuck to said double-sided tape and an end portion not stuck to said double-sided tape.

14. An image forming apparatus comprising:

a body member; a transfer sheet conveyor unit, including a conveyor roller rotatably mounted on said body member; and a conveyor roller cleaning device mounted on said body member for cleaning a peripheral surface of said conveyor roller, said conveyor roller cleaning device comprising:

an elastic member adapted to be pressed into contact with said conveyor roller for cleaning the peripheral surface thereof;

an attaching member having a base end and a tip end, with said elastic member connected to said tip end, said base end pivotably supported by said body member to permit pivoting of said attaching member around said base end between a setting position in which said elastic member is pressed into contact with said conveyor roller and a retreat position in which said elastic member is retracted away from said conveyor roller, said attaching member being maintained at said setting position by a reaction force corresponding to the pressing-contact force of said elastic member to said conveyor roller;

drive means for driving said conveyor roller; and drive control means for controlling said drive means such that, before paper to be conveyed by said transfer sheet conveyor unit reaches said conveyor roller, said drive means rotates said conveyor roller in a predetermined direction for a predetermined period of time, producing between the peripheral surface of said conveyor roller and said elastic member a frictional force by which said attaching member is biased to said setting position.

15. An image forming apparatus according to claim 14, wherein the conveyor roller comprises a resist roller for adjusting timing of conveying of a transfer sheet.

16. An image forming apparatus according to claim 14, wherein said drive control means is responsive to an image formation start signal.

17. An image forming apparatus according to claim 14, wherein said drive control means is responsive to execution of a maintenance processing on said image forming apparatus, to be operated at a point of time between the time of completion of the maintenance processing and the time when a transfer sheet to be conveyed by the transfer sheet conveyor unit reaches the conveyor roller.

18. An image forming apparatus according to claim 17, wherein said drive control means is further responsive to an image formation start signal.

19. An image forming apparatus according to claim 17, wherein said drive control means is further responsive to a reset signal supplied after completion of the maintenance processing.

20. An image forming apparatus according to claim 19, further comprising a front cover on said body member; and a limit switch for generating the reset signal in response to closing of said front cover.

21. An image forming apparatus according to claim 14, wherein:

said drive means includes:

(a) clutch means adapted to be engaged and disengaged to transmit and not transmit a driving force to said conveyor roller; and (b) clutch operating means for operating said clutch means; and said drive control means causes said clutch operating means to operate said clutch means to transmit the driving force to rotate said conveyor roller.

22. An image forming apparatus according to claim 14, wherein said attaching member comprises a conveyor guide plate for guiding a transfer sheet to be conveyed by said conveyor roller downstream in the conveying direction.

23. An image forming apparatus as claimed in claim 14, further comprising:

a first double-sided tape having a first surface stuck to said tip end of said attaching member and having a second surface;

a synthetic resin film having a first surface stuck to said second surface of said first double-sided tape and having a second surface; and a second double-sided tape having a first surface stuck to said second surface of said synthetic resin film and having a second surface stuck to said elastic member, thereby connecting said elastic member to said tip end.

24. An image forming apparatus as claimed in claim 23, wherein said synthetic resin film includes a first portion stuck to said first and second double-sided tapes and an end portion not stuck to either said first or said second double-sided tape.

25. An image forming apparatus as claimed in claim 14, further comprising:

a double-sided tape having a first surface stuck to said tip end of said attaching member and a second surface;

a synthetic resin film having a first surface stuck to said second surface of said double-sided tape and a second surface with said elastic member adhered thereto by an adhesive, thereby connecting said elastic member to said tip end.

26. An image forming apparatus as claimed in claim 25, wherein said synthetic resin film includes a first portion stuck to said double-sided tape and an end portion not stuck to said double-sided tape.

* * * * *